US006735935B2

(12) United States Patent
Hruby et al.

(10) Patent No.: US 6,735,935 B2
(45) Date of Patent: May 18, 2004

(54) PULSED HALL THRUSTER SYSTEM

(75) Inventors: Vladimir J. Hruby, Newton, MA (US); Bruce M. Pote, Sturbridge, MA (US); Manuel Gamero-Castano, Framingham, MA (US)

(73) Assignee: Busek Company, Natick, MA (US)

( * ) Notice: Subject to any disclaimer, the term of this patent is extended or adjusted under 35 U.S.C. 154(b) by 94 days.

(21) Appl. No.: 10/015,009

(22) Filed: Dec. 11, 2001

(65) Prior Publication Data

US 2002/0116915 A1 Aug. 29, 2002

Related U.S. Application Data

(60) Provisional application No. 60/255,681, filed on Dec. 14, 2000.

(51) Int. Cl.[7] ..... H05H 00/00
(52) U.S. Cl. ..... 60/202; 313/362.1; 315/111.61
(58) Field of Search ..... 60/202, 203.1; 313/362.1; 315/111.61

(56) References Cited

U.S. PATENT DOCUMENTS 3,309,873 A * 3/1967 Cann ..... 60/203.1
4,703,222 A * 10/1987 Yoshikawa et al. ..... 313/359.1
5,475,354 A * 12/1995 Valentian et al. ..... 60/202
5,646,476 A * 7/1997 Aston ..... 60/202
5,973,447 A * 10/1999 Mahoney et al. ..... 313/359.1
6,150,764 A 11/2000 Hruby et al.
6,456,011 B1 * 9/2002 Bugrova et al. ..... 315/111.41

OTHER PUBLICATIONS

Spanjers et al., "Investigation of propellant inefficiencies in a pulsed plasma thruster", American Institute of Aeronautics and Astronautics, Inc., AIAA Meeting Papers on Disc, Jul. 1996, AIAA Paper 96–2723.

Hruby et al., "Hall Thrusters Operating in Pulsed Mode" presented as paper IEPC–01–66 at the 27th International Electric Propulsion Conference, Pasadena, CA, Oct. 15–19, 2001.

Juergen Mueller, "Thruster Options for Microspacescraft: A Review and Evaluation of State–of–the–Art and Emerging Technologies", Micropropulsion for Small Spacecraft, Progress in Astronautics and Aeronatics, vol. 187, Copyright 2000, pp. 45–137.

* cited by examiner

*Primary Examiner*—Ted Kim
(74) *Attorney, Agent, or Firm*—Iandiorio & Teska

(57) ABSTRACT

A pulsed Hall thruster system includes a Hall thruster having an electron source, a magnetic circuit, and a discharge chamber; a power processing unit for firing the Hall thruster to generate a discharge; a propellant storage and delivery system for providing propellant to the discharge chamber and a control unit for defining a pulse duration $\tau<0.1d^3\rho/\dot{m}$, where d is the characteristic size of the thruster, $\rho$ is the propellant density at standard conditions, and $\dot{m}$ is the propellant mass flow rate for operating either the power processing unit to provide to the Hall thruster a power pulse of a pre-selected duration, $\tau$, or operating the propellant storage and delivery system to provide a propellant flow pulse of duration, $\tau$, or providing both as pulses, synchronized to arrive coincidentally at the discharge chamber to enable the Hall thruster to produce a discreet output impulse.

38 Claims, 10 Drawing Sheets

PULSED HALL THRUSTER SYSTEM

RELATED APPLICATIONS

This application claims priority of Provisional Patent Application Serial No. 60/255,681 filed Dec. 14, 2000.

Work under this invention was performed in part under the Small Business Innovation Research (SBIR) program, Air Force contract No. F04611-99-C-0018 and NASA Contract No. NAS3-0159.

FIELD OF THE INVENTION

This invention relates to a pulsed Hall thruster system and more particularly to a such system in which either the propellant flow or the electrical power or both is pulsed.

BACKGROUND OF THE INVENTION

Pulsed Hall thruster systems can be used for: propulsion of small spacecraft which lack sufficient power for steady state operation; attitude control in large spacecraft; and in spacecraft where steady state propulsion and/or delivery of small impulse bits are needed. One type of competing pulsed system, a cold gas thruster, uses pressurized gas expanded through a nozzle to create thrust. Such systems suffer from low specific impulse or thrust per unit mass flow. One such cold gas thruster is the Model 50-673 cold gas thruster triad available from Moog Space Products Division, East Aurora, N.Y. Another pulsed system, a pulsed plasma thrust (PPT) system employs an electrical arc to ablate a Teflon surface to create and accelerate a gasified Teflon. This suffers from low efficiency, potential for spacecraft contamination and produces impulse bits with low uniformity. Mueller, Juergen, "Thruster Options for Microspacecraft: A Review and Exaluation of State-of-the Art and Emerging Technologies", *Micropropulsion for Small Spacecraft*, Edited by Michael M. Micci and Andrew D. Ketsdever, AIAA Progress in Astronautics and Aeronautics Vol. 187. See also: Spanjers, Gregory G., McFall, Keith A., Gulczinski III, Frank S., and Spores, Ronald A., "Investigation of Propellant Inefficiencies in a Pulsed Plasma Thruster", Paper AIAA-96-2723, Joint Propulsion Conference, Orlando, Fla., Jul. 1–3, 1996; Hruby, V., Pote, B., Gamero-Castano, M. Kolencik, G., Byrne, L., Tedrake, R., and Delichatsios, M., "Hall Thrusters Operating in Pulsed Mode", IEPC-01-66, International Electric Propulsion Conference, Pasadena Calif., Oct. 15–19, 2001; and U.S. Pat. No. 6,150,764 to Hruby et al. entitled "Tandem Hall Field Plasma Accelerator".

Typically, Hall thrusters are started by establishing the magnetic field and then applying the starting voltage which typically exceeds the steady state discharge voltage. This results in hard starts, high initial current spikes and often non-repeatable discharge initiation: therefore they are not perceived as likely pulsed devices which could produce precisely controlled, repetitive impulses.

BRIEF SUMMARY OF THE INVENTION

It is therefore an object of this invention to provide a Hall thruster system capable of both pulsed and steady state operation.

It is a further object of this invention to provide such a pulsed Hall thruster system which precisely controls impulses.

It is a further object of this invention to provide such a pulsed Hall thruster system which produces variable impulses.

It is a further object of this invention to provide such a pulsed Hall thruster system which can produce very small impulses for accurate spacecraft positioning and attitude control.

It is a further object of this invention to provide such a pulsed Hall thruster system which provides discrete or repetitive impulses.

It is a further object of this invention to provide such a pulsed Hall thruster system which can operate in steady state or pulse mode.

It is a further object of this invention to provide such a pulsed Hall thruster system which has high efficiency and high specific impulse.

It is a further object of this invention to provide such a pulsed Hall thruster system which can be powered by a capacitor, power processing unit, or even directly from a solar photovoltaic array or other power sources.

The invention results from the realization that a pulsed Hall thruster system which can vary yet precisely control discrete and repetitive impulses with high efficiency and specific impulse can be achieved by pulsing either the power to the Hall thruster or the propellant flow to the thruster discharge chamber with a duration of $\tau$ where $\tau<0.1d^3\rho/\dot{m}$ as defined hereinafter or by pulsing both power and flow for approximately the same time and having them appear coincidentally at the discharge chamber.

This invention features a pulsed Hall thruster system including a Hall thruster having an operating electron source, a magnetic circuit and a discharge chamber. There is a power processing circuit for firing the Hall thruster to generate a discharge; and a control unit for operating the power processing unit to provide to the Hall thruster a power pulse of a pre-selected duration $\tau<0.1d^3\rho/\dot{m}$ where d is the characteristic size of the, $\rho$ is the propellant density at standard conditions, and $\dot{m}$ is the propellant mass flow rate. A propellant storage and delivery system is responsive to the control unit for providing a synchronized propellant pulse of pre-defined duration approximately the same as the pre-selected duration of the power pulse and coincident to the discharge chamber with the power pulse for enabling the Hall thruster to produce a discrete output impulse.

The invention also features a pulsed Hall thruster system including a Hall thruster having an operating electron source, a magnetic circuit, and a discharge chamber. A power processing unit fires the Hall thruster and the control unit operates the power processing unit to provide to the Hall thruster a power pulse of pre-selected duration $\tau<0.1d^3\rho/\dot{m}$, where d is the characteristic size of the thruster, $\rho$ is the propellant density at standard conditions, and $\dot{m}$ is the propellant mass flow rate. A propellant storage and delivery system is responsive to the control unit for providing a steady state supply of propellant to the discharge chamber for enabling the Hall thruster to produce a discrete output impulse.

The invention also features a pulsed Hall thruster system including a Hall thruster having an operating electron source, a magnetic circuit and a discharge chamber. A power processing unit fires the Hall thruster and a control unit operates the power processing unit to provide a continuous discharge voltage to the Hall thruster. A propellant storage and delivery system is responsive to the control unit for providing a propellant pulse of a pre-defined duration $\tau<0.1d^3\rho/\dot{m}$, where d is the characteristic size of the thruster, $\rho$ is the propellant density at standard conditions and $\dot{m}$ is the propellant mass flow rate for enabling the Hall thruster to produce a discrete output impulse.

In preferred embodiments the Hall thruster may include a propellant conduit system with an input port and an output port proximate to the discharge chamber and the propellant storage and delivery system may include a propellant accumulator proximate the input port and a valve between the accumulator and the input port. The accumulator may maintain approximately constant pressure in the propellant conduit system and the propellant may provide the synchronized propellant pulse to the discharge chamber. The pre-selected duration of the firing pulse and the pre-defined duration of the propellant pulse may be the same. The valve may be integral with the Hall thruster to reduce discharge chamber filling time. The power pulse width may be variable and the control unit may set the width of the power pulse. The power pulse repetition rate may be variable and the control unit may set the repetition rate. The power processing unit may include a capacitor for supplying the power of the power pulse. The magnetic circuit may be segmented to reduce eddy currents and reduced magnetic flux rise time. The magnetic circuit may have high electrical resistivity to reduce eddy currents and reduce magnetic field rise time. The propellant conduit system fill time may be approximately equal to the magnetic rise time of the magnetic circuit. The magnetic circuit may include an electromagnet. The electromagnet may be energized in series with the Hall thruster discharge. The electromagnet may be energized by an independent source which can lead or lag the Hall thruster discharge. The magnetic circuit may include a permanent magnet.

BRIEF DESCRIPTION OF THE DRAWINGS

Other objects, features and advantages will occur to those skilled in the art from the following description of a preferred embodiment and the accompanying drawings, in which.

PREFERRED EMBODIMENT

Figure 1:
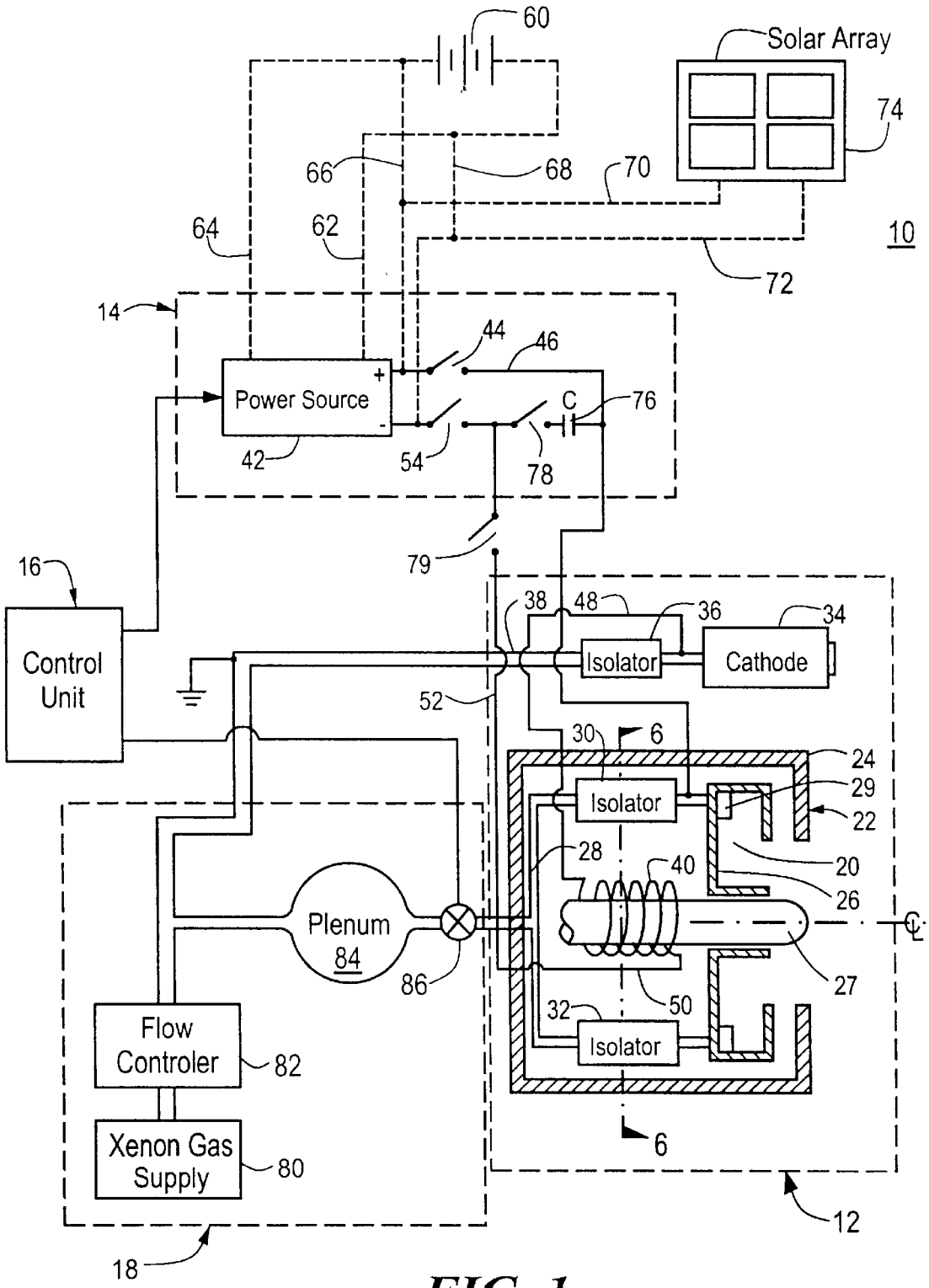
FIG. 1 is a schematic diagram of a pulsed Hall thruster system according to this invention.
Figure 13:
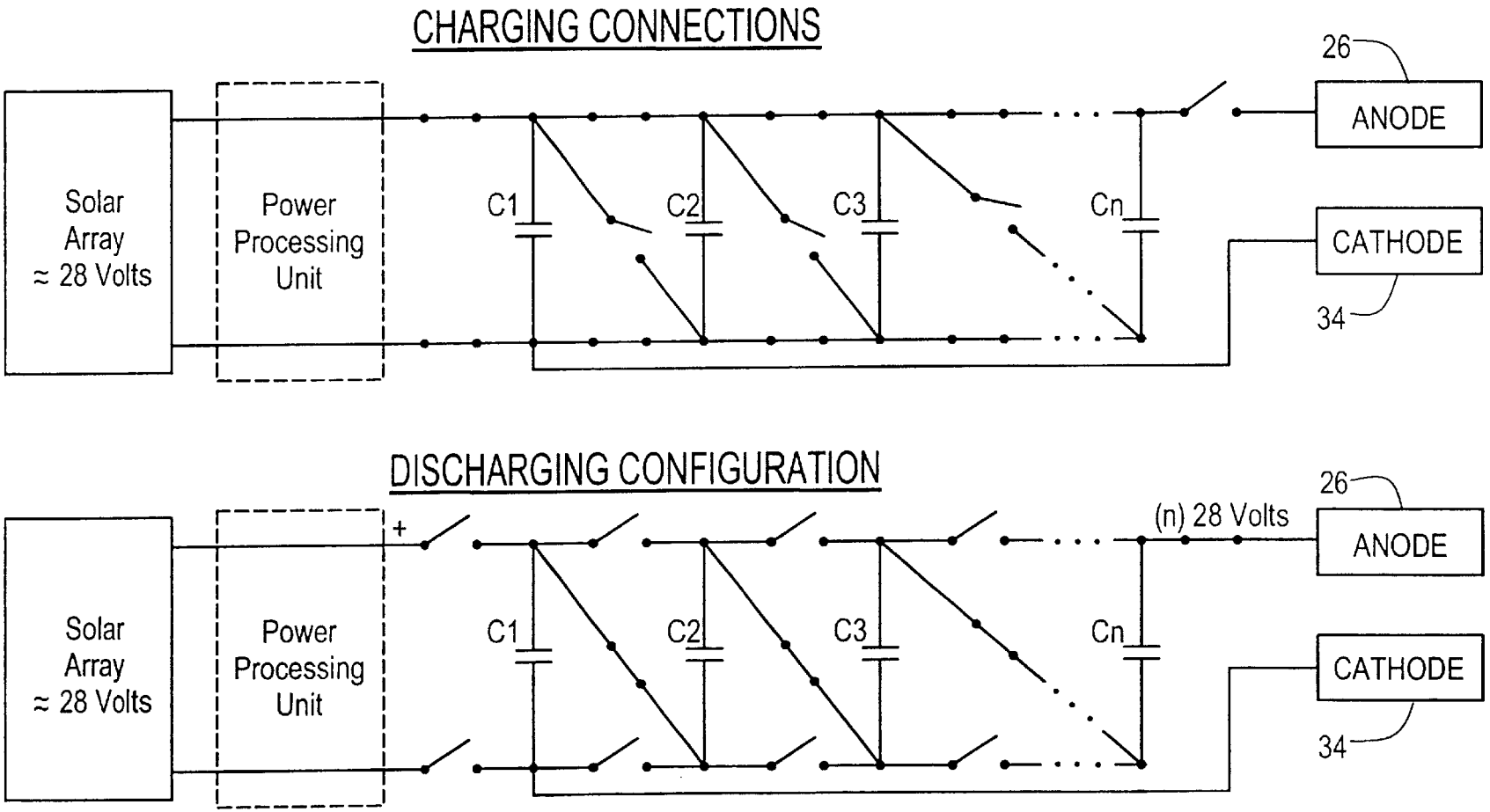
FIG. 13 is a schematic view of a parallel/series, charging/discharging circuit which can be used with this invention.
Figure 14:
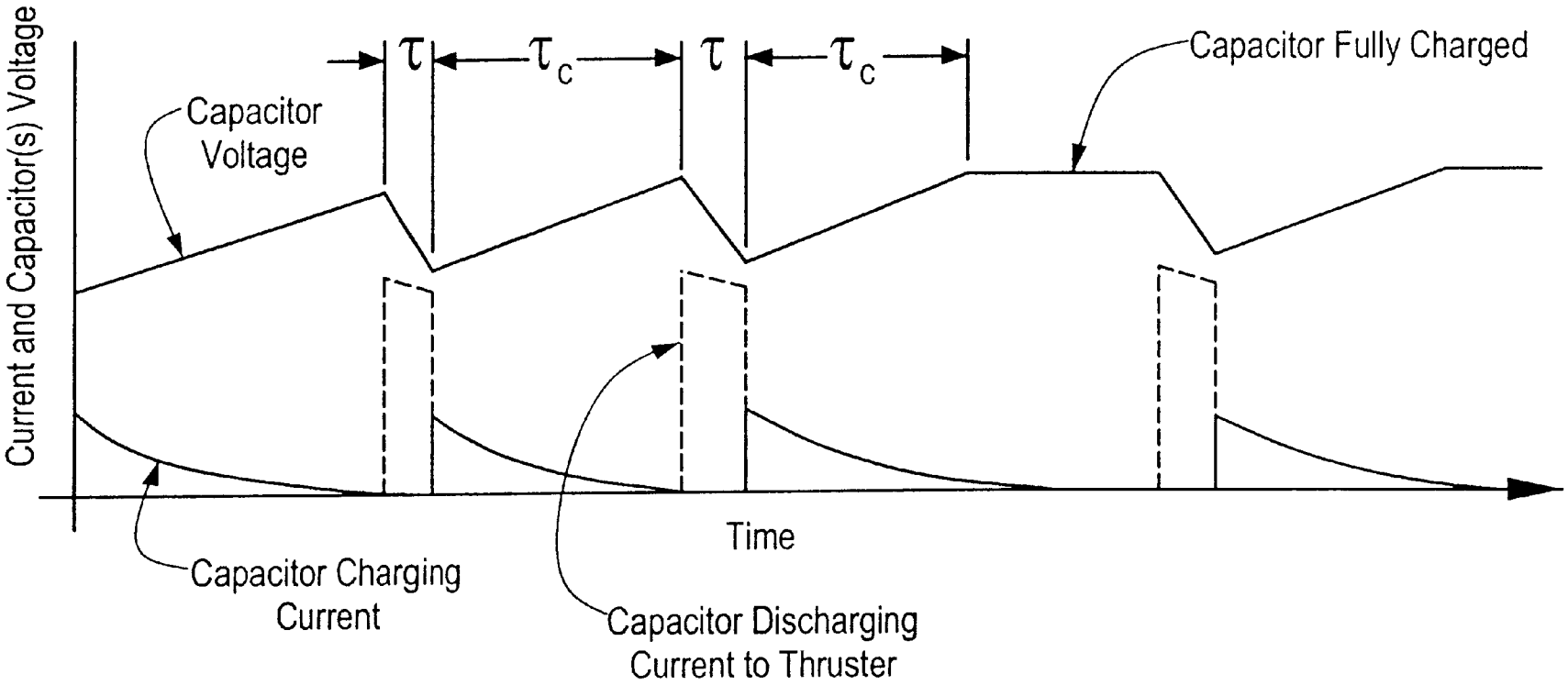
FIG. 14 illustrates the charging/discharging waveforms for the circuit of FIG. 13.

There is shown in FIG. 1 a pulsed Hall thruster system 10 according to this invention including a Hall thruster 12, a power processing unit 14 for firing the Hall thruster, a control unit 16 for operating the power processing unit 14 to provide to the Hall thruster 12, a power pulse of pre-selected duration for example $\tau$, where $\tau<0.1d^3\rho/\dot{m}$ and d is the characteristic size of the thruster, generally the discharge chamber unit diameter, $\rho$ is the propellant density at standard conditions, i.e., 0° centigrade and one atmosphere, $\dot{m}$ is the nominal propellant mass flow rate and the quantity $0.1d^3$ approximates the discharge volume of the typical thruster. A propellant storage and delivery system 18 is responsive to control unit 16 for providing a synchronized propellant pulse of pre-defined duration approximately the same as the pre-selected duration of the power pulse from power processing unit 14 and coincident with it at the discharge chamber 20 of thruster 12 for enabling thruster 12 to produce a discrete discharge pulse or output impulse. The discrete pulse may be a single pulse or one in a series of pulses. Thruster 12 also includes magnetic circuit 22 including magnetic structure 24 and anode 26. Thruster 12 also includes propellant conduit system 28 for delivering the propellant typically through isolator 30 and 32 to discharge chamber manifold 29 delivering flow to discharge chamber 20. Cathode 34 also receives propellant through isolator 36 over separate conduit 38. Magnetic circuit 22 may be powered by electromagnetic coil 40 which may be powered in series with the Hall thruster discharge circuit or by a separate power supply. Power processing unit 14 is shown as including power source 42. A positive output of power source 42 is delivered through switch 44 on line 46 to discharge chamber 20 and from there through the plasma discharge to cathode 34 to line 48 which is connected to coil 40 whose output on line 50 is delivered on line 52 back through switch 54 to the negative input of power source 42. Power processing unit 14 may be constructed in a number of ways in addition to that shown in full lines, in FIG. 1. For example, a battery 60 connected over lines 62 and 64 may be used to energize power source 42, or battery 60 could be connected directly to switches 44 and 54 over lines 66 and 68. Alternatively, switches 44 and 54 could be connected over lines 70 and 72 to solar array 74. Capacitor 76 may also function as a power source when the spacecraft has insufficient power onboard to drive the thruster continuously. The capacitor is charged through the use of switch 78 and discharged into the thruster through switch 79. For maximum utilization of the spacecraft power, the capacitor charging time $\tau_c$ and the charging power $P_c$ are related to the thruster discharge power ($P_{th}$) pulse duration $\tau$ by $\tau_c P_C \cong P_{th}\tau$ where $\tau_c>\tau$. The typical charging and discharging waveform is shown in FIG. 14. When $\tau_c P_C>P_{th}\tau$ the capacitor reaches its predetermined discharge voltage faster indicating that the charging power could be reduced or the discharge frequency could be increased. As an example, consider a small spacecraft capable of providing 50 watts of power from its solar array/power source to operate a 200-watt Hall thruster. In such a case the capacitor(s) would be charged for 200 msec and discharged into the thruster for 50 msec at a frequency of 4 Hz. In some cases where the solar array power source is incapable of providing the full voltage required, capacitance 76 may be replaced by a number of capacitances in parallel for charging and then switched into a series network to power the discharge chamber 20 and the magnetic circuit of thruster 12, as shown in FIG. 13. For example, using ten capacitors each charged in parallel to 28 volts a source of 280 volts can be available for discharge with the capacitors are rearranged in series.

In a thruster having a diameter, d, of approximately 20 mm using a propellant such as xenon, a propellant mass flow rate, $\dot{m}$, of 1 mg/sec using a propellant pulse synchronized with a power pulse of time, $\tau$, equal to 0.175 seconds and voltage of 250 volts where the propellant pulse takes of the order 0.010 seconds to reach the discharge chamber, the delivered impulse is 2 mNsec.

Propellant storage and delivery system 18 typically includes a supply of xenon gas 80 and a flow control device 82 for providing the propellant to the discharge chamber 20 through the propellant conduit 28. In accordance with this invention there is also included an accumulator, plenum 84, which provides a sufficient reserve of xenon so that when valve 86 is opened, the flow through propellant conduit 28 is sufficient to very rapidly fill the propellant manifold 29 so that the propellant is quickly presented at the discharge chamber 20 in time with the discharge pulse from power source 42. The pressure in plenum 84 delivered to discharge chamber 20 may be 20 Torr. The plenum 84 can be a separate and distinct volume as shown in FIG. 1 or a length of tubing. Control unit 16 may be any suitable device typically on board a space craft for this purpose e.g., digital control interface unit. Control unit 16 may include a microprocessor which operates power processing unit 14 and propellant storage and delivery system 18 for proper cooperation. For example, it may provide a steady flow of propellant through valve 86 to discharge chamber 20 while commanding power source 42 to provide a discrete pulse or a series of repetitive pulses to the discharge chamber 20. Or, more efficiently, it may provide a steady state voltage between the cathode 34 and the discharge chamber 20 while providing a discrete propellant flow pulse or a series of repetitive propellant flow pulses into discharge chamber 20 through the operation of valve 86. Or, even more efficiently, it may apply a power pulse from power source 42 between cathode 34 and discharge chamber 20 synchronously with the provision of a propellant flow pulse over propellant conduit 28 to discharge chamber 20 so that the two appear coincidentally at the discharge chamber. By pulse is meant a pulse of a duration $\tau$ where $\tau<0.1d^3\rho/\dot{m}$ as previously defined.

Figure 2:
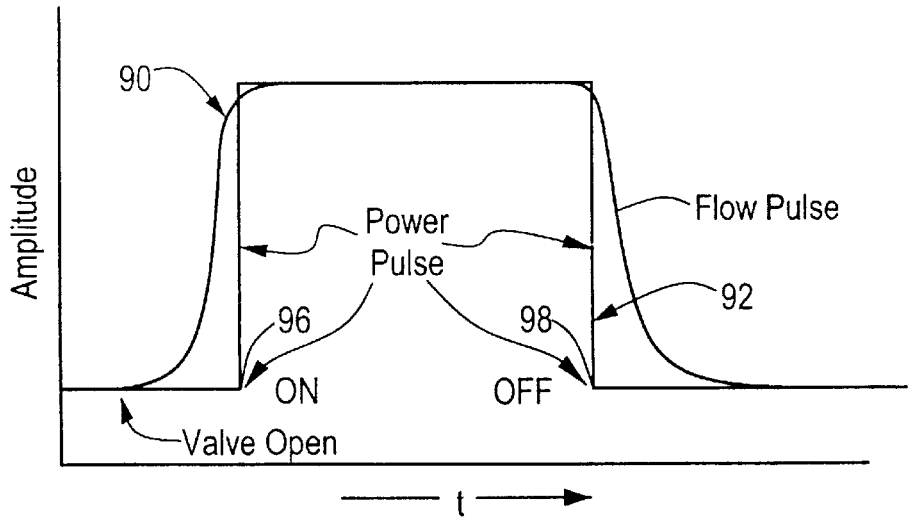
FIG. 2 illustrates a power pulse and flow pulse and their coincidence as may occur in the system of FIG. 1.
Figure 3:
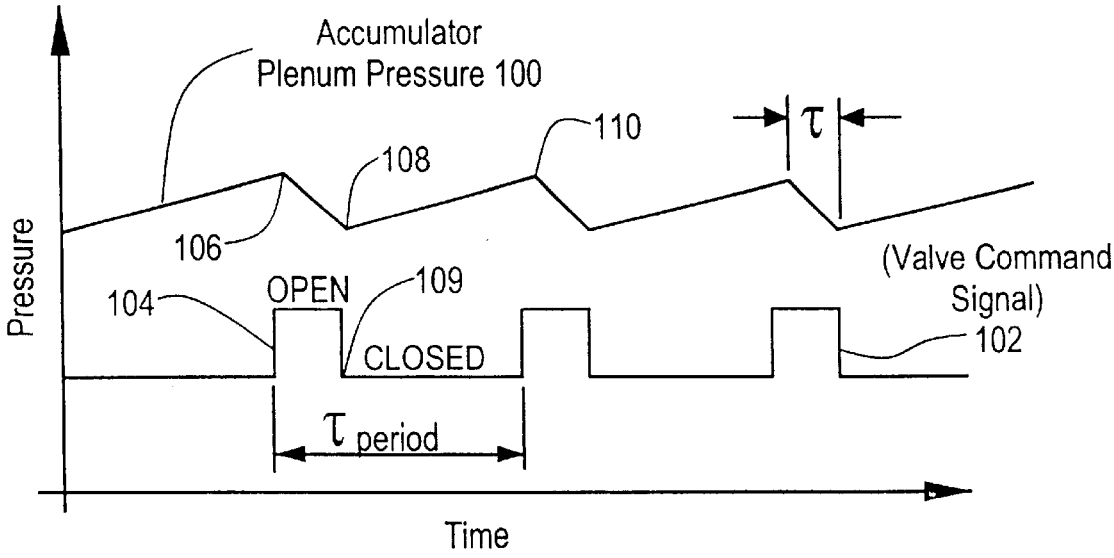
FIG. 3 illustrates nearly constant pressure achieved by the accumulator plenum controlled by the flow controller and valve in FIG. 1.

In accordance with this invention when both the propellant flow and electrical power are pulsed, an efficient coincidence of the two occurs as shown in FIG. 2, where the valve flow pulse 90 and the power pulse 92 are shown essentially coincident with the valve opening at approximately 94 and the power pulse coming on at 96 and going off at 98. The pulses occur together so that both the electrical power and the propellant supply are used efficiently. The use of the accumulator in FIG. 1, plenum 84, in conjunction with valve 86 enables the accumulator pressure to be maintained at a fairly constant level as shown in FIG. 3 while the flow control unit 82 is delivering constant mass flow rate. The accumulator pressure 100 varies only slightly in conjunction with the valve command signal 102. When the valve opens at 104, the pressure begins to drop at 106, but drops only very little as indicated at 108 by the time the valve is closing 109 and then returns to the nominal pressure at 110: the continually supplied average propellant flow $<\dot{m}>$ delivered by flow controller 82 and the discharge propellant flow m are related by $<\dot{m}>\tau_{period}\cong\dot{m}\tau$ where $\tau_{period}$ is defined in FIG. 3.

Figure 4:
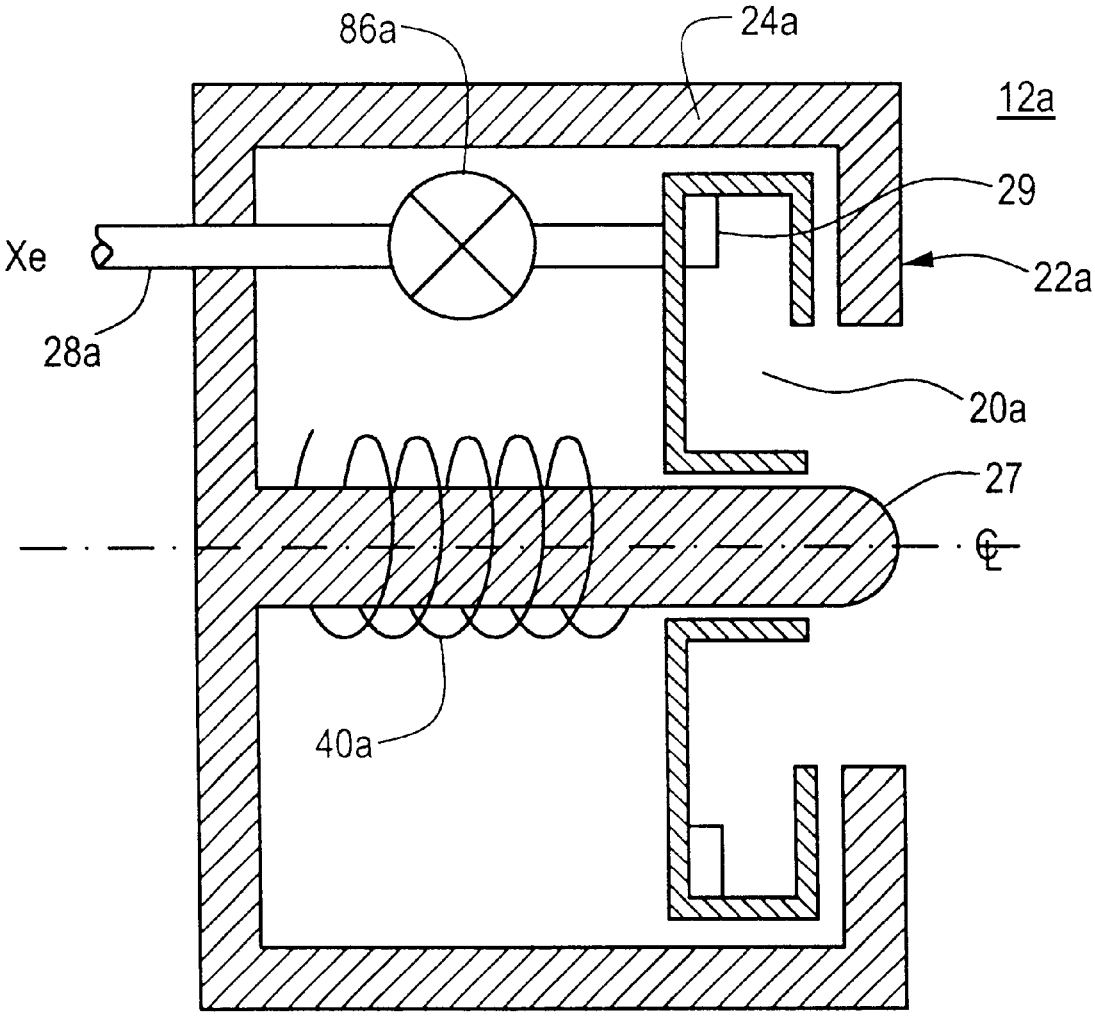
FIG. 4 is an enlarged schematic side sectional view of a portion of FIG. 1 showing an alternative construction with the valve in the thruster.

While accumulator, plenum 84, is closely proximate to thruster 12 and valve 86 is between them in FIG. 1, this is not a necessary limitation of the invention, as shown in FIG. 4, for example, where valve 86*a* is inside of thruster 12*a*. Placing the plenum 84 and the valve 12*a* as close as possible to the manifold 29 that has a small volume minimizes the discharge start up time and provides for efficient use of propellant.

Figure 5:
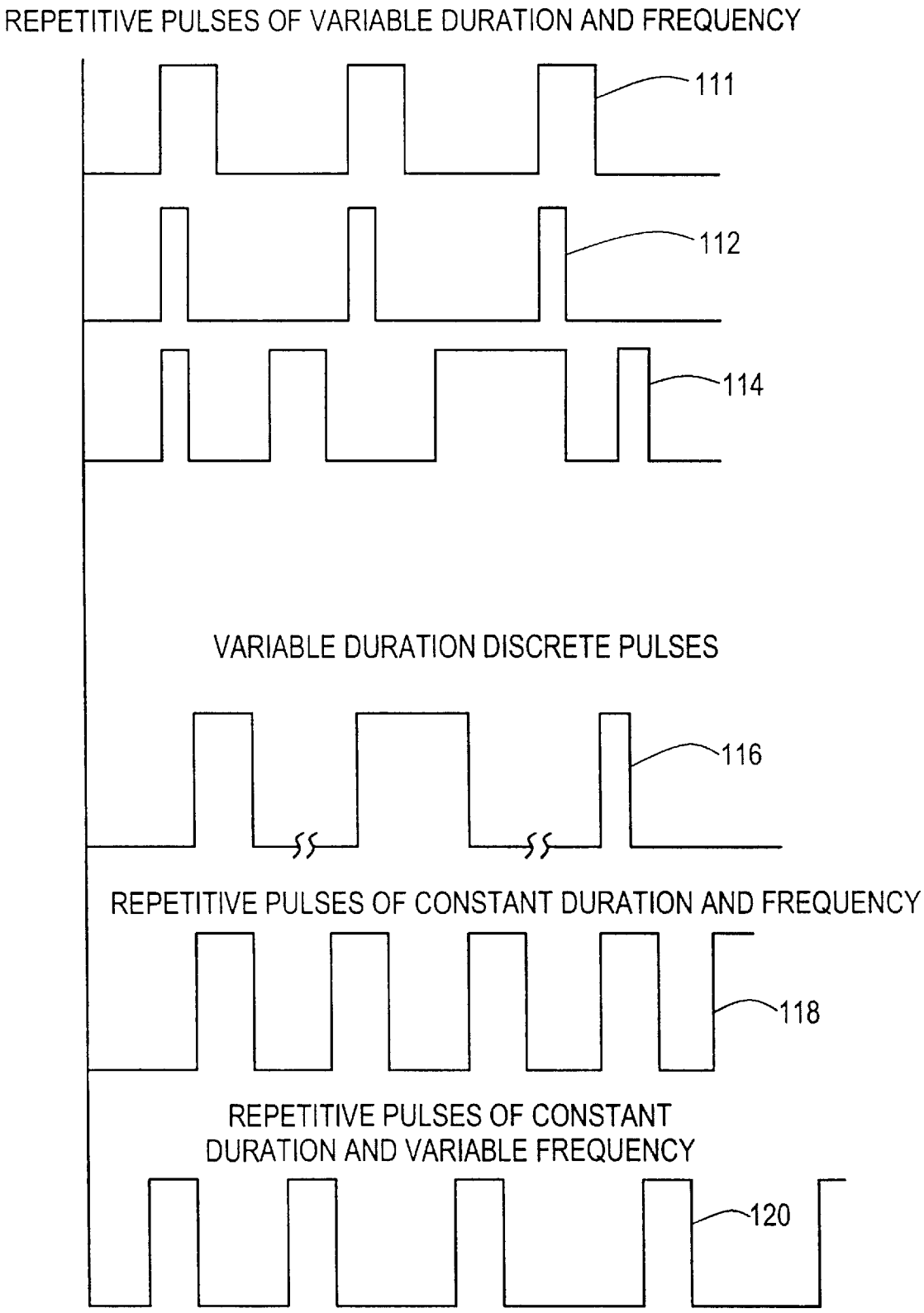
FIG. 5 illustrates a variety of discrete and repetitive pulses of different durations and frequencies produced by the control unit of FIG. 1.

Control unit 16 which drives power processing unit 14 or propellant storage and delivery system 18 or both of them to produce pulsed outputs may include a microprocessor and pulse generator for producing a number of different types of pulses to operate valve 86 and power source 42. The pulses may be discrete or repetitive. Discrete pulses may have different pulse widths or durations. Repetitive pulses may have different pulse widths or durations, different frequencies or any combination of these, as shown in FIG. 5 where repetitive pulses 111 have an unchanging frequency and width. Pulses 112 also are unchanging in pulse width or duration and frequency but are somewhat different in pulse width than pulses 111. And pulses 114 vary in both pulse width or duration and frequency. The discrete pulses 116 have varying pulse widths. Repetitive pulse widths 118 have constant duration and frequency while repetitive pulses 120 have constant duration and variable frequency.

Figure 6:
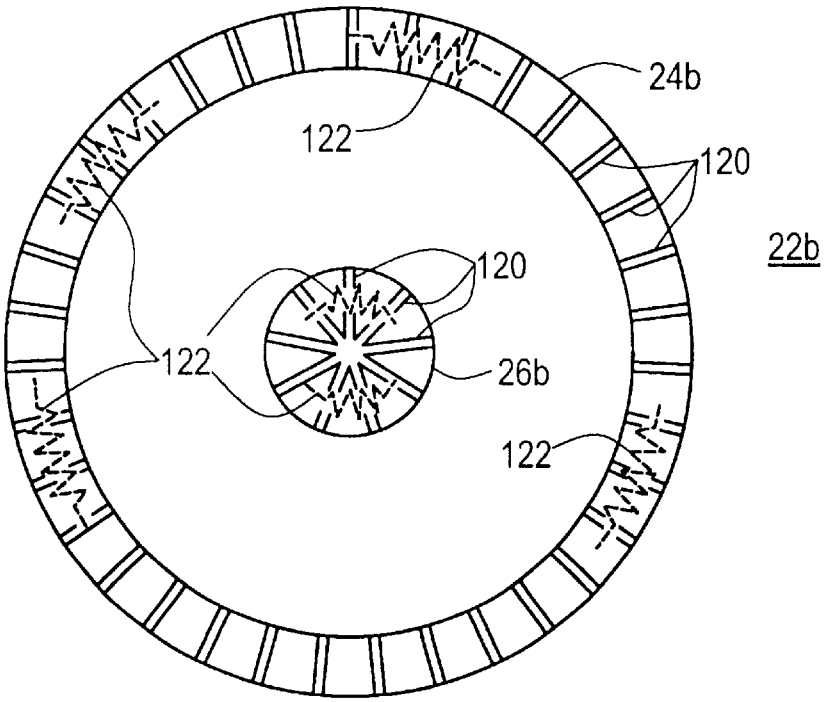
FIG. 6 is a schematic sectional view taken along line 6—6 of FIG. 1 showing another embodiment with segmented construction of the magnetic circuit for reducing eddy currents and magnetic rise time.

In order to improve the magnetic flux rise time of the magnetic circuit so that the discharge impulses will be sharper and more well defined, magnetic structure 24*b*, FIG. 6, in magnetic circuit 22*b* may be designed to reduce the eddy currents and thereby increase the magnetic flux rise time. This may be done by segmenting structure 24*b* and central stem 27 with insulation segments 120 or by radially azimuthally segmenting by winding the magnetic structure units' magnetic metal sheets similar to conventional transformer cores, or by increasing their resistance as indicated by phantom resistances 122 by using high resistivity magnetic materials such as ferrites and others.

Figure 7:
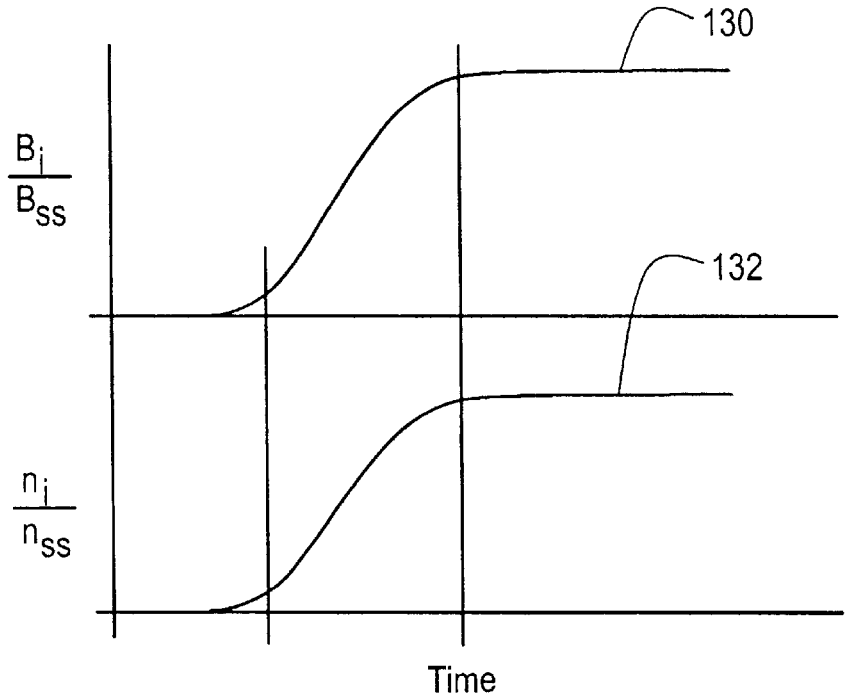
FIG. 7 illustrates fill time and magnetic rise time for propellant pulses and power pulses for the system of FIG. 1.

The coincidence or close matching of the power pulse and propellant pulse is even greater when the fill time of discharge chamber 20 and the magnetic flux rise time at magnetic circuit 22, are also closely matched. Such matching is shown for magnetic flux rise time 130 and fill time 132, FIG. 7 expressed as the instantaneous magnetic field $B_i$ over the steady state field $B_{ss}$ is plotted along the same timeline as the fill time where the instantaneous number of atoms per unit volume, $n_i$, over the steady state number of atoms per unit volume $n_{ss}$.

Figure 8:
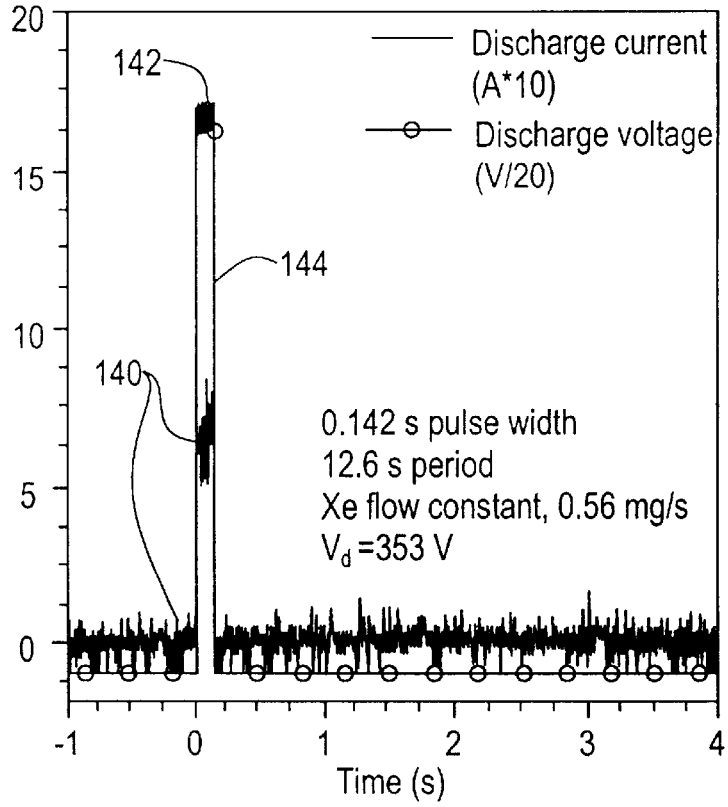
FIGS. 8 and 9 illustrate the discharge current and voltage with respect to time according to this invention for two different pulse widths.
Figure 9:
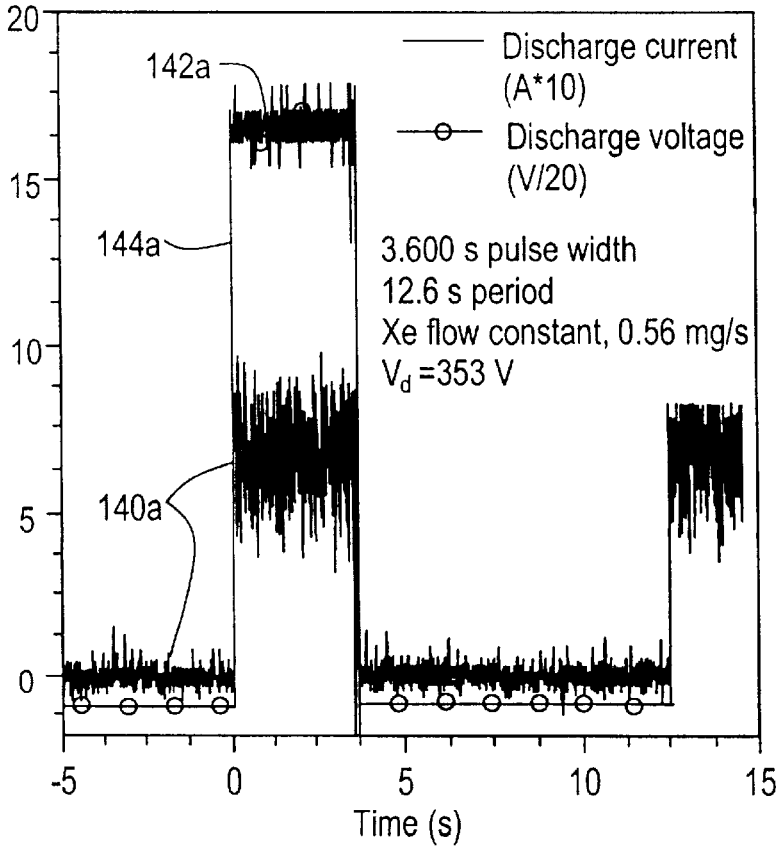
Figure 11:
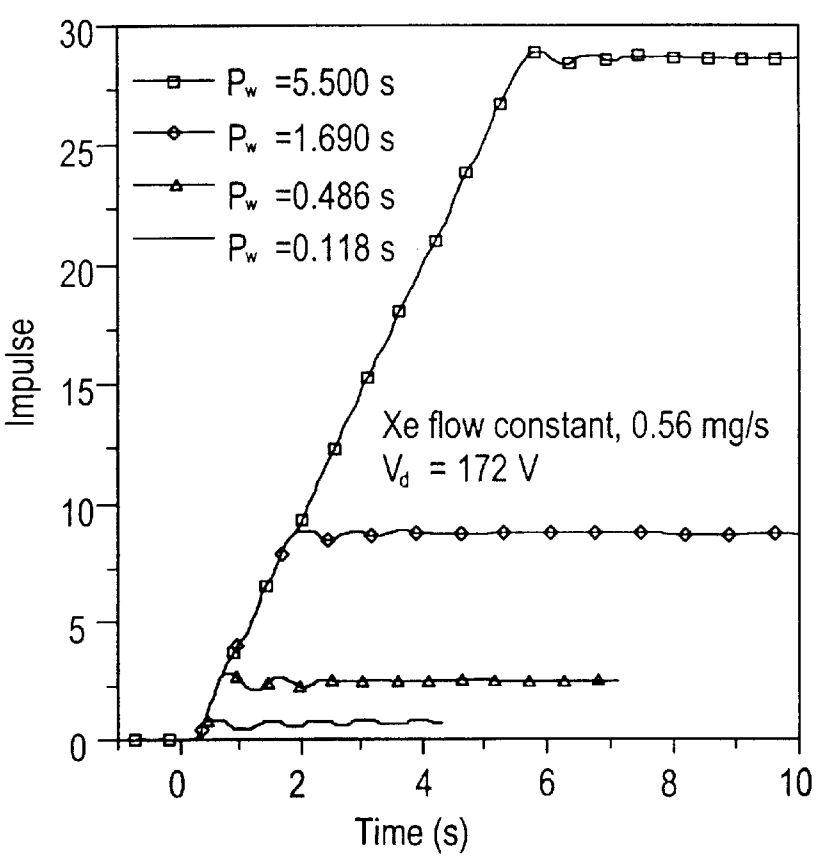
FIGS. 10 and 11 illustrate the linearity of impulse output with respect to pulse width according to this invention for two different discharge voltages.
Figure 10:
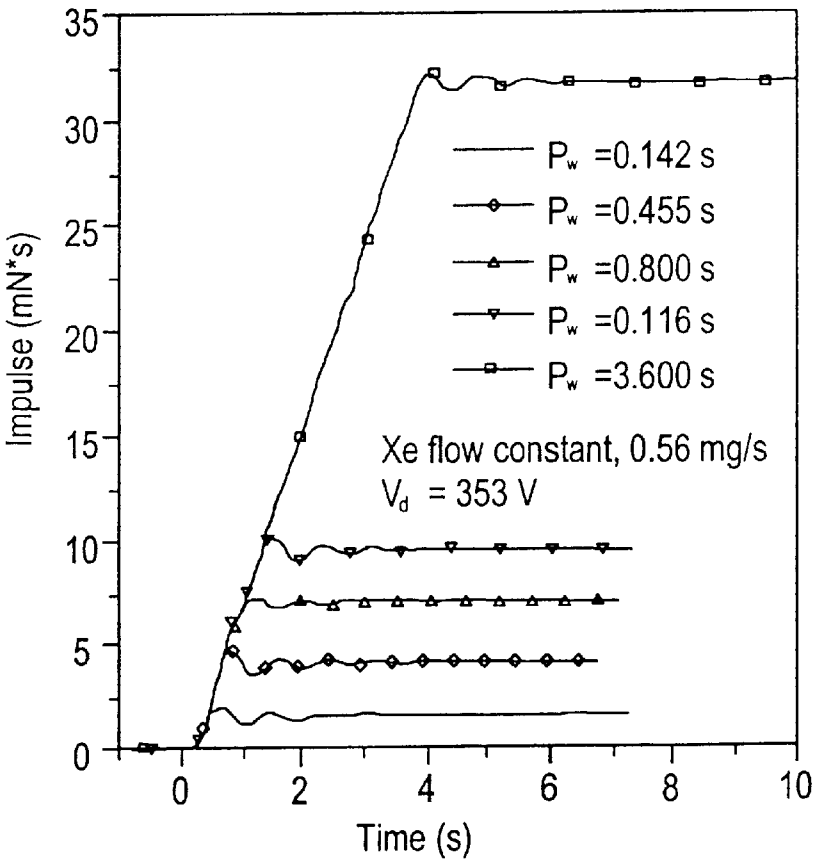

An example of the discharge current 140 and the discharge voltage 142 behavior at 350 volts for both the narrow pulse width of 0.142 seconds for the pulse 144 in FIG. 8, and for the wider pulse 144*a* of 3.6 seconds according to this invention is shown in FIG. 9. The linear characteristic of the impulse output for different pulse widths making for precise control of the impulse developed is shown in FIG. 10 for five different pulse widths, 0.142, 0.455, 0.800, 0.116, and 3.6 seconds at 353 volts and in FIG. 11 at 172 volts for four different pulse widths 5.5, 1.69, 0.486 and 0.118 seconds.

Figure 12:
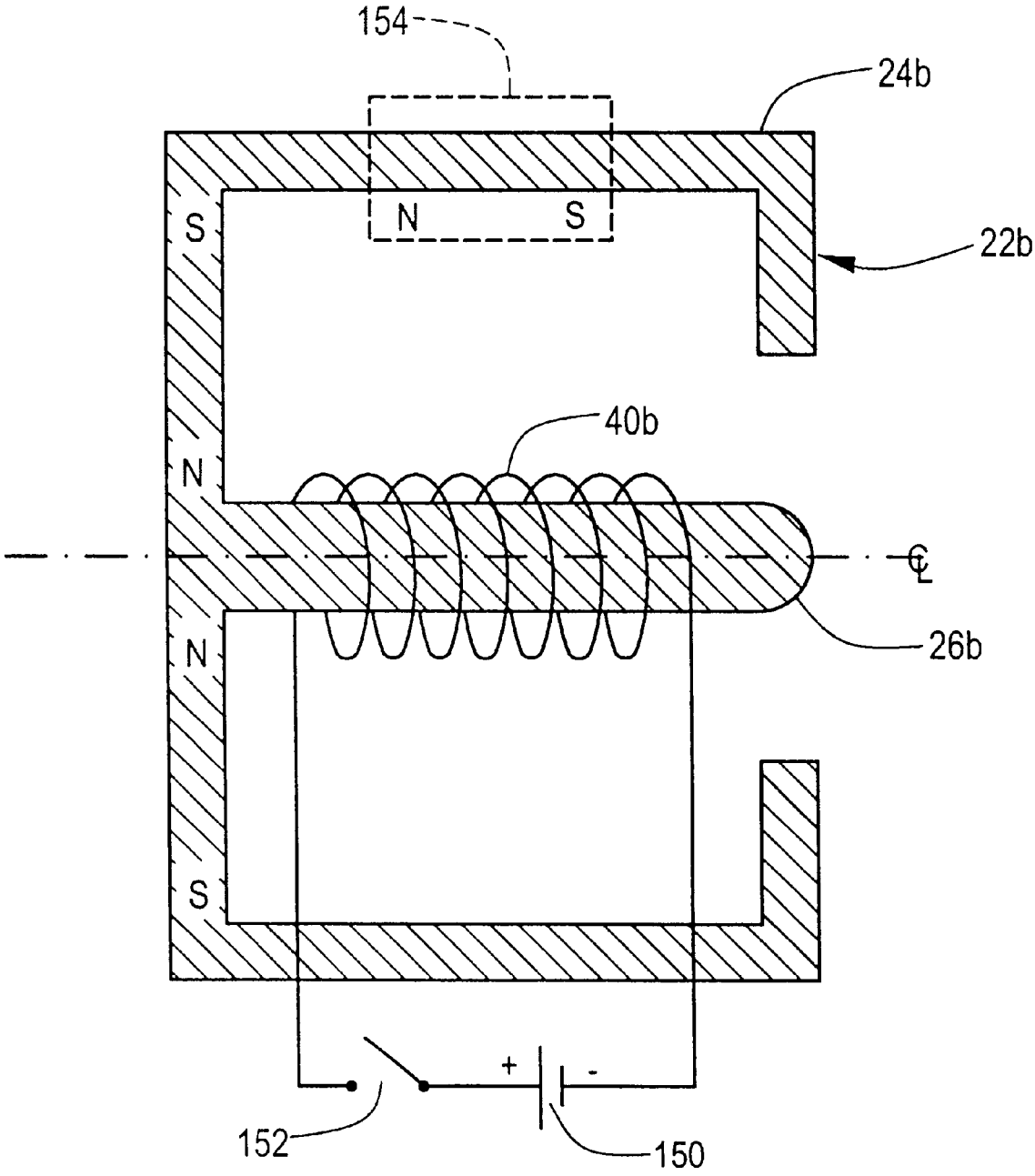
FIG. 12 is a schematic side, sectional, elevational view of the magnetic circuit of FIG. 1 with an independently energized electromagnet and with a permanent magnet according to another construction according to this invention.

In the construction of FIG. 1 where the electromagnet coil 40 is in series with the discharge, there is a limitation to how well the occurrence of the magnetic flux at the exit of discharge chamber 20 can be timed to the operation of the discharge circuit since magnetic flux produced by the electromagnet will naturally lag the discharge circuit due to the aforementioned eddy currents. This can be overcome by independently energizing coil 40*b*, FIG. 12, shown simply as a battery 150 and switch 152 so that the coil can be energized, for example, in advance of the energization of the discharge circuit thereby giving the magnetic flux time to have built to an initial level when the discharge occurs. The magnetic circuit is not limited to energization by an electromagnetic coil, for example a permanent magnet 154 could be used.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A pulsed Hall thruster system comprising:

a Hall thruster including an operating electron source, a magnetic circuit, and a discharge chamber;

a power processing unit for firing said Hall thruster to generate a discharge;

a control unit for operating said power processing unit to provide to said Hall thruster a discharge power pulse of pre-selected duration $\tau<0.1d^3\rho/\dot{m}$; where d is the characteristic size of the thruster, $\rho$ is the propellant density at standard conditions and $\dot{m}$ is the propellant mass flow rate; and a propellant storage and delivery system, responsive to said control unit, for providing a synchronized propellant flow pulse of pre-defined duration approximately the same as said pre-selected duration of said power pulse and coincident at said discharge chamber with said power pulse for enabling said Hall thruster to produce a discrete output impulse.

2. The pulsed Hall thruster system of claim 1 in which said Hall thruster includes a propellant conduit system with an input port and an output port proximate said discharge chamber and said propellant storage and delivery system includes a propellant accumulator proximate said input port and a valve between said accumulator and input port.

3. The pulsed Hall thruster system of claim 2 in which said valve is integral with said Hall thruster to reduce flow discharge chamber filling time.

4. The pulsed Hall thruster system of claim 2 in which said accumulator maintains approximately constant pressure in said propellant conduit system and said valve provides said synchronized propellant pulse to said discharge chamber.

5. The pulsed Hall thruster system of claim 2 in which said propellant conduit system fill time is approximately equal to the magnetic flux rise time at the exit of said discharge chamber.

6. The pulsed Hall thruster system of claim 1 in which said pre-selected duration of said firing pulse and said pre-defined duration of said propellant pulse are approximately the same.

7. The pulsed Hall thruster system of claim 1 in which said power pulse width is variable and said control unit sets the width of said power pulse.

8. The pulsed Hall thruster system of claim 1 in which said power pulse repetition rate is variable and said control unit sets the repetition rate.

9. The pulsed Hall thruster system of claim 1 in which said power processing unit includes a capacitor for supplying the power of said discharge power pulse.

10. The pulsed Hall thruster system of claim 1 in which said magnetic circuit is segmented to reduce eddy currents and reduce magnetic flux rise time.

11. The pulsed Hall thruster system of claim 1 in which said magnetic circuit has high electrical resistance to reduce eddy currents and reduce magnetic flux rise time.

12. The pulsed Hall thruster system of claim 1 in which said magnetic circuit includes an electromagnet.

13. The pulsed Hall thruster system of claim 1 in which said electromagnet is energized in series with said Hall thruster discharge.

14. The pulsed Hall thruster system of claim 1 in which said electromagnet is energized by an independent source which can lead or lag said Hall thruster discharge.

15. The pulsed Hall thruster system of claim 1 in which said magnetic circuit includes a permanent magnet.

16. A pulsed Hall thruster system comprising:

a Hall thruster including an operating electron source, a magnetic circuit, and a discharge chamber;

a power processing unit for firing said Hall thruster;

a control unit for operating said power processing unit to provide to said Hall thruster a discharge power pulse of pre-selected duration $\tau<0.1d^3\rho/\dot{m}$ where d is the characteristic size of the thruster, $\rho$ is the propellant density at standard conditions and $\dot{m}$ is the propellant mass flow rate; and a propellant storage and delivery system, responsive to said control unit, for providing a steady state supply of propellant to said discharge chamber for enabling said Hall thruster to produce a discrete output impulse.

17. The pulsed Hall thruster system of claim 16 in which said power pulse width is variable and said control unit sets the width of said power pulse.

18. The pulsed Hall thruster system of claim 16 in which said power pulse repetition rate is variable and said control unit sets the repetition rate.

19. The pulsed Hall thruster system of claim 16 in which said power processing unit includes a capacitor for supplying the power of said power pulse.

20. The pulsed Hall thruster system of claim 16 in which said magnetic circuit is segmented to reduce eddy currents and reduced magnetic flux rise time.

21. The pulsed Hall thruster system of claim 16 in which said magnetic circuit has high electrical resistance to reduce eddy currents and reduce magnetic flux rise time.

22. The pulsed Hall thruster system of claim 16 in which said magnetic circuit includes an electromagnet.

23. The pulsed Hall thruster system of claim 22 in which said electromagnet is energized in series with said Hall thruster discharge.

24. The pulsed Hall thruster system of claim 22 in which said electromagnet is energized by an independent source which can lead or lag said Hall thruster discharge.

25. The pulsed Hall thruster system of claim 16 in which said magnetic circuit includes a permanent magnet.

26. The pulsed Hall thruster system of claim 16 in which said power processing unit includes a switched capacitor network for charging in parallel and discharging in series.

27. The pulsed Hall thruster system of claim 26 in which said power processing unit includes a solar array for charging said capacitors.

28. The pulsed Hall thruster system of claim 27 in which said solar array is a low voltage array.

29. The pulsed Hall thruster system of claim 28 in which said solar array is a 28 volt array.

30. The pulsed Hall thruster system of claim 29 in which said capacitor network includes a plurality of capacitors.

31. A pulsed Hall thruster system comprising:

a Hall thruster including an operating electron source, a magnetic circuit, and a discharge chamber;

a power processing unit for firing said Hall thruster;

a control unit for operating said power processing unit to provide a discharge voltage to said Hall thruster; and a propellant storage and delivery system, responsive to said control unit, for providing a propellant flow pulse of pre-defined duration $\tau<0.1d^3\rho/\dot{m}$, where d is the characteristic size of the thruster, $\rho$ is the propellant density at standard conditions and $\dot{m}$ is the propellant mass flow rate, to said discharge chamber for enabling said Hall thruster to produce a discrete output impulse.

32. The pulsed Hall thruster system of claim 31 in which said Hall thruster includes a propellant conduit system with an input port and an output port proximate said discharge chamber and said propellant storage and delivery system includes a propellant accumulator proximate said input port and a valve between accumulator and input port.

33. The pulsed Hall thruster system of claim 32 in which said accumulator maintains approximately constant pressure in said propellant conduit system and said valve provides said synchronized propellant pulse to said discharge chamber.

34. The pulsed Hall thruster system of claim 32 in which said valve is integral with said Hall thruster to reduce discharge chamber filling time.

35. The pulsed Hall thruster system of claim 31 in which said power processing unit includes a capacitor for supplying the power of said power pulse.

36. The pulsed Hall thruster system of claim 31 in which said magnetic circuit includes an electromagnet.

37. The pulse Hall thruster system of claim 31 in which said electromagnet is energized in series with said Hall thruster discharge.

38. The pulsed Hall thruster system of claim 31 in which said magnetic circuit includes a permanent magnet.

* * * * *